United States Patent [19]

Bendall

[11] 4,010,707

[45] Mar. 8, 1977

[54] MARINE PROPULSION UNIT

[76] Inventor: Wilfrid H. Bendall, Castle Hill Road, Pawcatuck, Conn. 06379

[22] Filed: June 11, 1976

[21] Appl. No.: 695,146

[52] U.S. Cl. ..... 115/12 R; 115/42

[51] Int. Cl.[2] ..... B63H 11/02; B63H 21/24

[58] Field of Search ..... 115/11, 12 R, 12 A, 115/42, 14; 60/221, 232

[56] References Cited

UNITED STATES PATENTS

| | | | |
|---|---|---|---|
| 2,112,948 | 4/1938 | Anderson | 115/12 R |
| 3,073,277 | 1/1963 | Lee | 115/12 R |
| 3,105,353 | 10/1963 | Schulz | 60/221 |
| 3,173,397 | 3/1965 | Beard | 115/12 A X |
| 3,295,490 | 1/1967 | Hiatt | 60/221 X |
| 3,397,538 | 8/1968 | Then et al. | 115/12 X |
| 3,422,789 | 1/1969 | Wynne et al. | 115/12 R |

FOREIGN PATENTS OR APPLICATIONS

| | | | |
|---|---|---|---|
| 567,569 | 2/1945 | United Kingdom | 115/12 A |
| 1,071,054 | 6/1967 | United Kingdom | 115/12 A |

*Primary Examiner*—Trygve M. Blix
*Assistant Examiner*—Gregory W. O'Connor

[57] ABSTRACT

A propulsion unit for vessels has rotatably interconnected upper and lower housing portions, the upper portion being arranged to extend horizontally through the hull and permit rotation of the unit in a vertical plane for access to the lower portion. The lower portion is independently rotatable through 360° to provide steering and reverse functions and includes a screw propeller positioned for rotation in a horizontal plane enclosed by fluid inlet and outlet ducts, a shallow depth inlet duct being the only projection below the hull bottom line. The unit is designed to provide normal propulsion for slow and medium speed boats and jet propulsion for light, high speed planing craft.

8 Claims, 2 Drawing Figures

10
40
14
44
18
23
62
61
60
19
22
21
12

25
50
52
46
42
47
11
71
45
70
72
24
26
28
16
34
20
30
32

MARINE PROPULSION UNIT

SUMMARY OF THE INVENTION

Despite their recognized advantages, efficient marine propulsion units as at present designed and manufactured, tend to be relatively heavy, mechanically complicated, and expensive to install and maintain in service. In the jet propulsion form, largely restricted to planing type hulls, they additionally require a plurality of submerged, relatively large hull openings.

The primary object of the present invention is to provide an efficient propulsion unit of simple, low cost design, light in weight, easy to install, and with inherent high accessibility for inspection and maintenance.

A further object is to provide such a unit able to utilize the conventional screw propeller for efficient operation of both moderate speed displacement boats and surface planing vessels utilizing the propeller fluid jet reaction, where hull weight and power are suitably related.

THE DRAWINGS

DETAILED DESCRIPTION

Figures 1, 2:
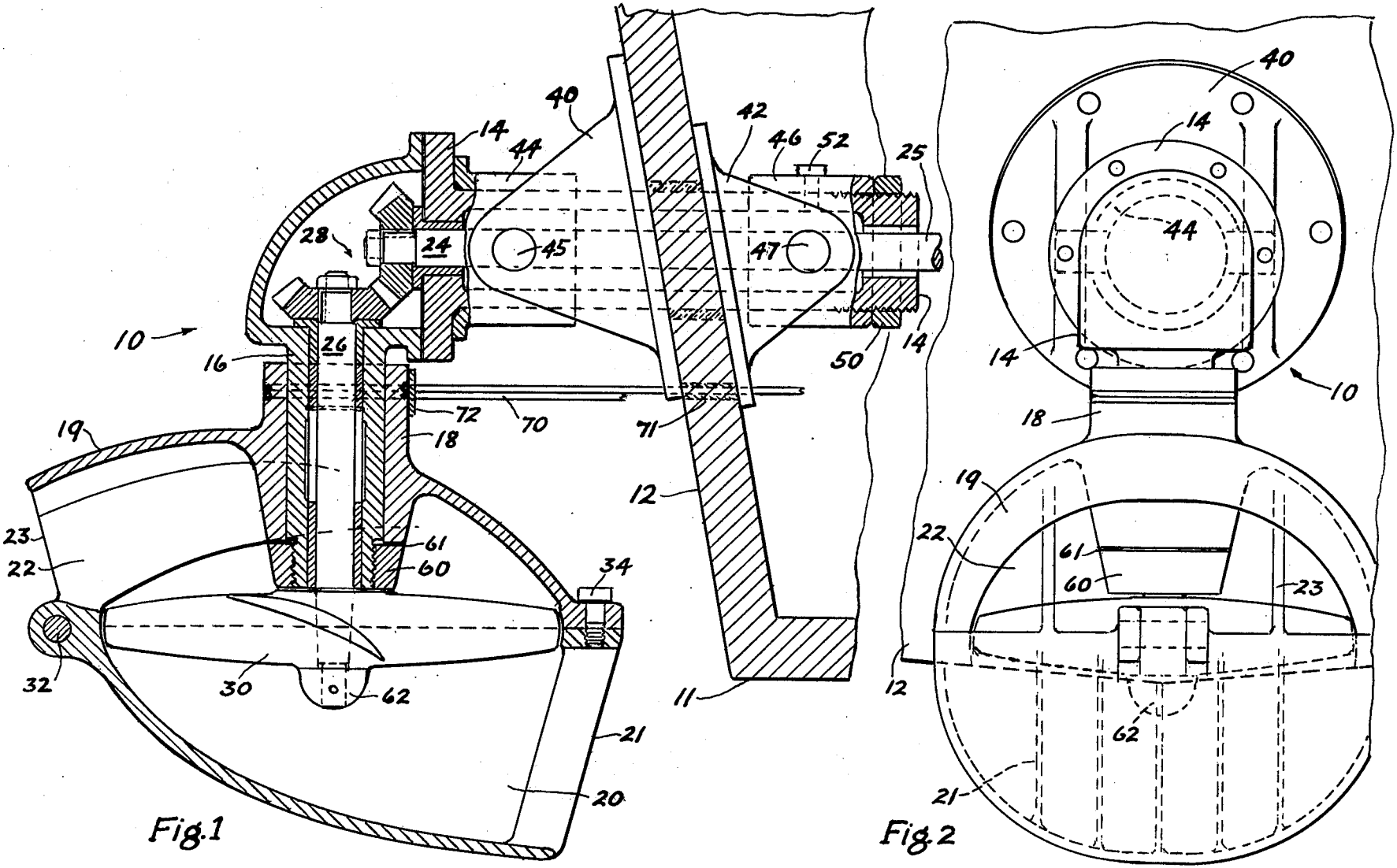
FIG. 1 is a partly diagrammatic, partly sectioned longitudinal elevational view of the marine propulsion unit of this invention showing it attached to the stern of a vessel.
FIG. 2 is a rear elevational view of the unit of FIG. 1.

As shown in FIG. 1 the propulsion unit 10 is mounted on the stern of a vessel 12 and comprises a housing having a horizontal upper portion 14 extending longitudinally through the hull and rotatable about its horizontal axis together with a lower vertical portion 16 having a concentric outer housing 18. Housing 18 is separately rotatable about a vertical axis and comprises an integral fluid inlet duct 20 and outlet duct 22. In the upper and lower housings drive shafts 24 and 26 are interconnected to drive through bevel gear pair 28. Drive shaft 24 is extended horizontally beyond the housing to provide an end portion 25 for coupling to an engine, while drive shaft 26 extends vertically downward for attachment of the screw propeller 30.

The propulsion unit thus described is mounted on the hull of the vessel by adjustable outboard and inboard brackets, 40 and 42 respectively, attached to the hull by screws or bolts. The outboard bracket 40 is provided with annular ring 44 and the inboard bracket 42 with annular ring 46, both slidably engaging and supporting the extended upper housing 14 of the unit. The annular rings are pivoted to the brackets at pivot centers 45 and 47. Arranged thus the brackets and pivoted supporting rings are axially adjustable to accommodate various hull thicknesses and inclination angles and the propulsion unit is then secured in final axial adjustment by the locking nut 50. After installation as described a locking screw 52 secures the unit against inadvertent rotation about the horizontal axis.

Inlet duct 20 of housing 18 is provided with a debris barrier comprising protective grid bars 21 and is hinged to the outlet duct 22 at its rear portion with hinge pivot 32, the portion thus hinged being secured with lockscrew 34. This arrangement, with the described facility for rotating the unit about its horizontal axis, permits convenient access to the propeller from inboard the vessel while afloat. Outlet duct 22, integral with vertical housing portion 18 is provided with swirl-reducing fluid guide vanes 23 and is shaped generally as shown, with converging walls 19. A tapered retaining nut 60 holds and supports housing 18 for free rotation on a bearing portion 61 of the nut. The propeller is retained by locknut 62. Flexible cables 70, extending through fairleads 71 in the hull, are secured to housing 18 with locking plate 72, enabling 360° rotational control movement of the housing and its ducting to effect the required steering, reversing and general manoeuvering functions of the vessel. It will be observed that this assembly ensures good access to the important propulsion elements. Removing locknut 62 enables removal of the propeller. Subsequent detachment of the steering cables 70 and removal of bearing locknut 60 enables removal of the entire ducted propeller housing.

The propulsion unit of this invention preferably is mounted on the vessel with the propeller located for rotation in a horizontal plane substantially above and closely adjacent to the surface of the fluid wake leaving the bottom surface 11 of the vessel when under way. Mounted thus, inlet duct 20 is the only projection below the bottom line of the hull and, with the vessel's forward motion, constitutes a rammed fluid intake to the propeller. The working fluid thus enters and leaves the ducts along substantially parallel lines relative to the hull for propulsive thrust with minimum duct turbulence and surface friction.

What is claimed is:

1. A propulsion unit for marine vessels comprising a housing having an upper portion extending longitudinally through the hull and a lower portion extending normal thereto external to the hull, said housing being rotatable about its horizontal axis, said lower portion having a concentric outer housing rotatable thereon, drive shafts in the upper and lower housing portions, said drive shafts having bevel gears interconnecting the shaft inner end portions, the outer end of the drive shaft in the upper housing being extended for connection to a power plant and the outer end of the drive shaft in the lower housing being extended for connection to a screw propeller, said unit being arranged for attachment to the vessel with the propeller rotating in a horizontal plane substantially above and closely adjacent to the surface of a working fluid wake leaving the bottom surface of the vessel when under way, said outer housing comprising a fluid inlet duct on one side of the propeller plane and an outlet duct on the opposite side, said inlet and outlet ducts, respectively, providing a rammed intake and directed discharge of the working fluid inducted when the vessel is under way, said outer housing being rotatable about its vertical axis for directional control of the vessel and said upper housing having adjustable mounting means for attachment of the unit to the vessel.

2. A propulsion unit as defined in claim 1 wherein said mounting means comprise flanged brackets coaxial with the housing upper portion for attachment to the inner and outer surface of the vessel, each of said brackets having a transversely pivoted annular member slidably engaging and supporting the upper portion of the unit and being axially adjustable to accommodate varying thicknesses and inclinations of the inner and outer hull attachment surfaces.

3. A propulsion unit as defined in claim 2 wherein said annular members include locking means securing said unit against inadvertent axial and rotational movement.

4. A propulsion unit as defined in claim 1 further comprising directional control means for effecting complete left hand or right hand rotation of the lower portion.

5. A propulsion unit as defined in claim 4 wherein said control means comprise flexible cables extending through fairleads in the hull of the vessel connected to said unit.

6. A propulsion unit as defined in claim 4 in which said lower portion is selectively rotatable to effect forward, lateral and reverse manoeuvring of the vessel.

7. A propulsion unit as defined in claim 1 wherein the unit is rotatable in a vertical plane for access to the lower portion while the vessel is afloat.

8. A propulsion unit as defined in claim 1 wherein the working fluid inlet and outlet flows are held substantially parallel to the plane of propeller rotation.

* * * * *